US010368640B2

(12) United States Patent
Scharer et al.

(10) Patent No.: US 10,368,640 B2
(45) Date of Patent: Aug. 6, 2019

(54) LOAD MODULE FOR INSERTING INTO A TUBE OF A THREE-DIMENSIONAL SUPPORTING TUBE STRUCTURE OF A FURNITURE SYSTEM

(71) Applicant: USM Holding AG, Muri bei Bern (CH)

(72) Inventors: Alexander Scharer, Muri bei Bern (CH); Thomas Dienes, Bern (CH); Stefan Krenger, Thun (CH)

(73) Assignee: USM Holding AG, Muri Bei Bern (CH)

( * ) Notice: Subject to any disclaimer, the term of this patent is extended or adjusted under 35 U.S.C. 154(b) by 0 days.

(21) Appl. No.: 15/739,242

(22) PCT Filed: Jun. 13, 2016

(86) PCT No.: PCT/EP2016/063498
§ 371 (c)(1),
(2) Date: Dec. 22, 2017

(87) PCT Pub. No.: WO2016/207008
PCT Pub. Date: Dec. 29, 2016

(65) Prior Publication Data

US 2019/0069677 A1 Mar. 7, 2019

(30) Foreign Application Priority Data

Jun. 23, 2015 (EP) ..... 15405042

(51) Int. Cl.
*F21S 4/28* (2016.01)
*F21V 7/00* (2006.01)
(Continued)

(52) U.S. Cl.
CPC ..... *A47B 96/1433* (2013.01); *A47B 97/00* (2013.01); *F21S 4/28* (2016.01);
(Continued)

(58) Field of Classification Search
CPC ..... A47B 96/1433; A47B 2220/0077; A47B 97/00; F21V 33/0012; F21V 7/0083;
(Continued)

(56) References Cited

U.S. PATENT DOCUMENTS

2013/0188338 A1* 7/2013 Melhaff ..... A47B 57/485 362/127
2015/0295447 A1* 10/2015 Nitz ..... A47B 21/06 320/103
2017/0198888 A1* 7/2017 Seifert ..... F21V 23/06

FOREIGN PATENT DOCUMENTS

WO WO2007071746 * 6/2007 ..... F21S 4/00

* cited by examiner

*Primary Examiner* — Peggy A Neils
(74) *Attorney, Agent, or Firm* — GableGotwals

(57) ABSTRACT

A load module for inserting into a tube of a three-dimensional supporting tube structure of a furniture system comprises an elongate housing. Arranged on an outer side of the housing are two contact elements having different polarities for electrically contacting the load module. The contact elements arranged such that, with the load module in inserted states, they contact two contact surfaces of different polarity, which are arranged in the interior of the tube, in a radial direction. Housing has a central region in a longitudinal direction with at least one projecting element and outer regions in the longitudinal direction, the load module can be inserted into a tube, which is provided with an elongate opening, of the tube structure such that the at least one projecting element interacts with an edge of the opening, and the outer regions bear against an inner lateral surface of the tube in regions adjoining the opening. A first of the contact elements is arranged in a first circumferential position in one of the outer regions.

13 Claims, 4 Drawing Sheets

(51) Int. Cl.

| | |
|---|---|
| ***A47B 96/14*** | (2006.01) |
| ***A47B 97/00*** | (2006.01) |
| ***F21V 19/00*** | (2006.01) |
| ***F21V 33/00*** | (2006.01) |
| ***F21Y 103/10*** | (2016.01) |
| ***F21Y 115/10*** | (2016.01) |

(52) U.S. Cl.
CPC .. *F21V 33/0012* (2013.01); *A47B 2220/0077* (2013.01); *F21V 7/0083* (2013.01); *F21V 19/0025* (2013.01); *F21Y 2103/10* (2016.08); *F21Y 2115/10* (2016.08)

(58) Field of Classification Search
CPC .... F21V 19/0025; F21S 4/28; F21Y 2103/10; F21Y 2115/10
See application file for complete search history.

200

LOAD MODULE FOR INSERTING INTO A TUBE OF A THREE-DIMENSIONAL SUPPORTING TUBE STRUCTURE OF A FURNITURE SYSTEM

CROSS-REFERENCE TO RELATED APPLICATIONS

This application is the United States National Phase of Patent Application No. PCT/EP2016/063498 filed 13 Jun. 2016, which claims priority to European Application No. 15405042.1 filed 23 Jun. 2015 each of which are incorporated herein by reference.

BACKGROUND OF THE INVENTION

Technical Field

The invention relates to a load module for insertion into a tube of a three-dimensional load-bearing tube structure of a furniture system, wherein the load module comprises an elongate housing, and wherein two contact elements for making electrical contact with the load module, which contact elements have different polarities, are arranged on an outer side of the housing. The invention further relates to a furniture system with a three-dimensional load-bearing tube structure and at least one load module of said kind.

PRIOR ART

Furniture systems with a three-dimensional load-bearing tube structure, comprising a plurality of tubes and a plurality of three-dimensional node elements, wherein two or more tubes can be fastened to connection points of one of the three-dimensional node elements, are known.

By way of example, CH 429 317 (U. Scharer Wine) discloses a tube connection for frame production, in which, for the purpose of detachably connecting the tube ends to one another, a connecting head with in each case one threaded bore for each tube end is provided. The threaded bores run in the respective axial direction. Cap screws which project into the tube end can be screwed into said threaded bores, the said cap screws having, on their shaft, two wedge sleeves which are lined up with one another by way of the wedge surface and with the connecting head or the screw cap by way of the end side which is averted from said wedge surface and secure the tube end on the inside when the screw is tightened.

It is necessary to arrange loads, for example luminaires, in or on items of furniture and furniture systems and/or to supply electrical energy to said loads. Loads such as luminaires can be, for example mechanically, fastened to the tube structure, and supply cables can be routed through openings of the furniture from the rear. Ducts in which supply cables of said kind can be routed in an inconspicuous or invisible manner are likewise common.

Loads, such as luminaires for example, which are fastened to the tube structure and the supply lines to said loads often have a detrimental effect on the appearance of the furniture system and sometimes also impede use, for example when a portion of the receiving space, which is defined by the tube structure, is required for accommodating the loads or the loads protrude into said receiving space or an access area.

Therefore, approaches are known which use tubes of a furniture system for accommodating loads or at least elements of said loads. For example, WO 94/21961 A1 (Planlicht-Handelsgesellschaft mbH & Co. KG) discloses a lighting system with a carrier profile for constructing items of furniture, display cabinets, shelving arrangements etc., which lighting system has bores which are spaced apart from one another. Luminaire units can be inserted into in each case one bore of the carrier profile. An electrical conductor is arranged in the carrier profile, a pin-like contact part of the inserted luminaire unit making electrical contact with said electrical conductor. The luminaire itself is arranged outside the profile.

A recessed luminaire, which can be inserted into a cutout of a tube, which cutout is shaped in the manner of an elongate hole, is disclosed in EP 1 963 734 A1 (Dreisewerd). The recessed luminaire comprises notches which are provided on both sides and, after the positioning of the recessed luminaire, engage behind the wall of the tube as flange ends of said recessed luminaire. Conductor tracks and LEDs are connected by way of plug-in tongues to two connection plugs, which allow the electrical connections to be established on the outside, on an LED printed circuit board. The connection plugs are provided on that side of the LED printed circuit board which is averted from the end faces of the LEDs. In this case, the plug-in tongues allow connection of the supply line with corresponding plug-in connectors which are known from motor vehicle electrics.

DE 20 2012 003 663 U1 (Horst Lettenmayer) discloses a shelving arrangement comprising system tubes and threaded nodes which connect said system tubes. The shelving arrangement has a lighting device, wherein at least one of the system tubes has a central, elongate partial groove which does not extend as far as the threaded nodes, and wherein an LED lighting body can be inserted into the system tube. Power is supplied to the LED lighting body within the system tube, and the system tube, the LED lighting body and the threaded nodes can be braced against one another and secured by tensioning tensioning rods which are arranged within the system tube. In order to supply power to the LED lighting body which is located in the region of the partial groove, a contact button can be provided, which contact button bears in a resilient manner against a contact which is arranged at the longitudinal end of the LED lighting body and is supplied with power via a wire. Both LED lighting bodies which have two contacts on the same side and also LED lighting bodies which have two contacts at their opposite longitudinal ends are possible.

The lighting bodies which form load modules can therefore be accommodated within the system tubes. However, mechanically holding and making contact with the lighting body is complicated.

SUMMARY OF THE INVENTION

The problem addressed by invention is that of providing a load module which is suitable for the technical field mentioned at the outset, which load module can be held and with which contact module contact can be made in a simple and reliable manner in the tube of the three-dimensional load-bearing tube structure.

According to the invention, the contact elements are arranged in such a way that, when the load module is in the inserted state, they make contact in a substantially radial direction with two contact areas of different polarity which are arranged in the interior of the tube. In this case, the housing has a region which is central in the longitudinal direction, which region has at least one projecting element, and also regions which are on the outside in the longitudinal direction, wherein the load module can be inserted into a tube of the tube structure, which tube is provided with an elongate cutout, in such a way that the at least one projecting element interacts with an edge of the cutout, and the outer regions bear against an inner casing of the tube in regions which adjoin the cutout. A first of the contact elements in one of the outer regions is arranged in a first circumferential position.

The load module according to the invention can be accommodated substantially completely in the tube. However this does not mean that individual elements cannot protrude out of the cross section which is defined by the tube. The housing of the load module is elongate and therefore matched to the geometry of the tube. The extent in the longitudinal direction (that is to say parallel to the longitudinal axis of the tube in the installed state) is, for example, at least 4 times greater, in particular at least 6 times greater, than the extent in the transverse direction (that is to say in the radial direction with respect to the tube).

According to the invention and in contrast to the prior art, the two contact elements are arranged in such a way that they make contact in a substantially radial direction with the conductors which run in the tube. That is to say, the contact regions which are defined by the contact elements and the contact areas in the interior of the tube when the load module is in the installed state are located between the casing surfaces of the housing and the inner casing of the tube and not approximately axially on the end sides of the housing.

It has been found that this arrangement allows electrical contact to be made with the load module in a considerably simpler manner. At the same time, the load module can be easily and securely mechanically held in the tube. The first contact element can make direct contact with a contact area of the tube in the region which adjoins the cutout, for example the tube element which is manufactured from conductive material itself.

For the purpose of interacting with the cutout, the housing of the load module according to the invention has a region which is central in the longitudinal direction, which region has at least one projecting element, and also regions which are on the outside in the longitudinal direction. The load module can then be inserted into the tube of the tube structure, which tube is provided with the elongate cutout, in such a way that the at least one projecting element interacts with an edge of the cutout, and the outer regions bear against an inner casing of the tube in regions which adjoin the cutout. The load module is held in a secure manner and in a defined position on the tube in this way.

The at least one projecting element may be a flat structure which is matched to the geometry of the cutout or a structure which replicates the edge of the cutout in a matching manner or a plurality of structures which interact with the edge of the cutout at points which are spaced apart from one another. Interaction between the at least one projecting element and the edge of the cutout therefore leads to unambiguous definition of the position of the housing of the load module in the tube of the tube structure.

According to the invention, a first of the contact elements is arranged in a first circumferential position in one of the outer regions of the housing of the load module. The contact element, with the load module inserted, is preferably arranged in a region of the load module, which region adjoins the cutout. That is to say, the first circumferential position corresponds substantially to the circumferential position of the central region with the at least one projecting element. The first contact element can therefore make direct contact with a contact area of the tube in the region which adjoins the cutout, for example the tube element which is manufactured from conductive material itself.

The invention further relates to a furniture system with a three-dimensional load-bearing tube structure, which furniture system comprises the following:

a) a plurality of tubes, wherein at least one of the tubes has two contact areas of different polarity which are arranged in the interior of the tube;
b) a plurality of three-dimensional node elements for mechanically fastening two or more tubes to one another;
c) at least one load module for insertion into the at least one tube of the three-dimensional load-bearing tube structure of the furniture system, wherein the load module comprises an elongate housing, and wherein two contact elements for making electrical contact with the load module, which contact elements have different polarities, are arranged on an outer side of the housing, and the contact elements are arranged in such a way that, when the load module is in the inserted state, they make contact in a substantially radial direction with two contact areas of different polarity which are arranged in the interior of the tube.

The furniture system may be, for example, a shelving system, a cabinet system, a drawer system or a system with different components from amongst said components. The furniture system is, in particular, of modular construction. This means that a large number of different configurations can be constructed virtually without restriction with a limited number of basic elements (tubes, node elements and built-in and built-on components).

The cross section of the tubes can assume different shapes. By way of example, it can have the outer shape of a circle or of a regular polygon, but irregular closed or even open shapes are also possible.

The three-dimensional node elements allow the connection of a plurality of tubes which, in the fastened state, do not all necessarily have to lie on the same line or in the same plane. Node elements which have six connection points which are arranged on the outer side of an imaginary cube are particularly preferred. Accordingly, furniture of which the structural elements (tubes) run along a three-dimensional rectangular lattice can be constructed using tubes and node elements of this kind. The node elements themselves can accordingly be cube-shaped or have a different suitable shape, for example that of a sphere. The node elements can be designed in such a way that electrical connections are created, preferably using two poles, between tubes which are fastened to the same node element.

A furniture system of this kind is described, in particular, in pending European patent application no. 13 405 139.0 dated Dec. 13, 2013 by the same applicant.

It is not compulsory for all tubes and all node elements to have said contact areas or current-conducting properties. Tubes and node elements which do not carry current can be combined with the elements which do carry current within the scope of a furniture system according to the invention.

A load module can comprise, in particular, a lighting element. The lighting element is preferably arranged in the load module in such a way that the load module is accommodated substantially completely in the cross section which is defined by the tube of the furniture system. As a result, an advantageous simple appearance can be achieved, and the accommodation space provided by the furniture system or the access to said accommodation space is not adversely affected. Various lighting elements are possible, specifically those with single, punctiform or flat light sources or a plurality of light sources, those which generate diffuse light and those which generate targeted light. The lighting elements can be designed with diffusers, reflectors and/or screens. Said lighting elements can be designed such that the brightness and/or color or color temperature can be adjusted. Light can be generated on the basis of LED or OLED modules, but other technologies are likewise applicable.

Load modules with other functions are likewise covered by the invention. Said load modules can therefore comprise connection elements, for example sockets and/or plugs, for connecting loads, or else cooling, heating or ventilation devices. In the same way as load modules, control modules or sensor modules can be accommodated in a tube of the tube structure. Said control modules or sensor modules serve, for example, for controlling loads which are integrated in the same module, other load modules and/or external devices. The sensors may be, in particular, motion, presence, light or temperature sensors. Further sensors can interact specifically with the furniture system and detect, for example, opening of a door. By way of example, the lighting element of a load module can be selectively switched on when a door which closes an interior space of the tube structure, which interior space is illuminated by the lighting element, is opened. A single module can perform several functions (load, control arrangement, sensor system).

Communication between insert modules is performed preferably by means of powerline communication (PLC) by data being modulated onto the power transmission line of the furniture system. Corresponding electronics are contained in the insert modules (sensor, control and load modules). Other types of transmission, for example via separate control lines, or wirelessly by means of a suitable protocol, for example Bluetooth, are likewise possible.

The modules are identified by unique numbers; assignment is performed by means of a central database or locally by means of settings in the individual modules. Setting of the assignment is performed with the aid of an external control device or by a "pairing" method which can be initiated solely by operator control of the modules.

The at least one of the tubes preferably has two current conductors, which run along the tube and are insulated from one another, for carrying current of a first polarity and of a second polarity along the tube. Therefore, current can be carried directly by the tubes of the furniture system; separate feed lines are superfluous.

The two current conductors, which are insulated from one another, for carrying current are preferably arranged coaxially to one another in the at least one tube. This arrangement can be produced in a cost-effective manner and allows sufficiently high current strengths with a small radial cross section. Furthermore, correspondingly equipped tubes can be combined in a simple manner with node elements in which the two polarities are transmitted likewise in a coaxial manner between the tubes, as is clear, for example, from EP 13 405 139.0 which has already been mentioned. This then results in a particularly simple conductor arrangement in all of the structural elements of the furniture system involved.

The at least one tube preferably comprises a structural tube element which is composed of a conductive material and serves to carry the first polarity, and an internal conductor, which is accommodated in an insulated manner in the structural tube element, for carrying the second polarity. The first polarity is, in particular, the neutral conductor (ground). Therefore, the construction of the tube is particularly simple.

The internal conductor can be formed by a conductive foil which is inserted into the tube and is insulated at one end. This results in a simple production of the tubes which are provided with conductors. Other variants are possible; for example, the internal conductor can be formed by a corresponding coating which is separated by an insulation layer from the conductive material which serves to carry the first polarity.

As an alternative, the conductors can also run differently in the at least one tube. By way of example, they can be arranged in a linear manner parallel in relation to one another.

The at least one tube advantageously comprises an elongate cutout, and the at least one load module is advantageously designed in such a way that it can be inserted into the at least one tube through the elongate cutout. The load module can therefore also be inserted into the tube when the tube structure is already completed, that is to say the tubes are already connected to the node elements. The load module can preferably also be readily removed from the tube again, without the tube having to be detached from the node element. Therefore, the configuration can be quickly and easily matched to the existing requirements. A screen can be inserted into tubes which are provided with a cutout but are not currently intended to accommodate a load module, in order to close the cutout.

The cutout is advantageously arranged in the tube in such a way that it does not extend as far as an end of the tube. This ensures a high degree of stability of the tube and prevents problems in the event of interaction with the node elements or connecting mechanisms.

According to the invention, a first of the contact elements in one of the outer regions of the housing of the load module is arranged in a first circumferential position. The contact element, with the load module inserted, is preferably arranged in a region of the load module, which region adjoins the cutout. That is to say, the first circumferential position corresponds substantially to the circumferential position of the central region with the at least one projecting element. The first contact element can therefore make direct contact with a contact area of the tube in the region which adjoins the cutout, for example the tube element which is manufactured from conductive material itself.

A second of the contact elements is preferably arranged in a second circumferential position which encloses an angle of at least 60°, preferably at least 90°, particularly preferably at least 135°, with the first circumferential position. This results in good support of the contact elements, and faulty contact-making operations are reliably avoided.

In a preferred embodiment, the first contact element is arranged substantially in the extension of the center line of the central region, while the second contact element is arranged on the rear side of the housing, in a manner offset through 180°, in its circumferential position. The second of the contact elements of the at least one load module, with the load module inserted, is therefore arranged in a region of the load module, which region is at the rear in relation to the cutout.

At least one of the contact elements is advantageously of resilient design, in particular a contact element which is located in a circumferential position which is spaced apart from the circumferential position of the central region. It is also possible for both contact elements to be of resilient design. The reliability of the electrical contact-making operation is increased in this way. At least one of the resilient contacts likewise preferably serves, in addition to making electrical contact, for mechanically fixing the module to the tube. If at least one of the resilient contacts, specifically a contact which is arranged on that side of the load module which is averted from the cutout, is designed with a comparatively large spring travel, secure support and positioning in the tube can be achieved even with a relatively low depth of the housing. At the same time, insertion and removal of the load module through the cutout is greatly simplified owing to the low depth.

In the case of a lighting element, the light exit area is advantageously arranged in the central region of the housing, in particular as part of the projecting element. The emitted light can therefore reach the solid-angle regions which are to be illuminated—substantially without being impeded by the surrounding tube. Shading losses are avoided. Furthermore, an advantageous appearance is produced with the lighting element switched on.

In a preferred embodiment, a lighting element according to the invention therefore has an elongate housing which has a projecting element in a central region on a first side (or in a first circumferential region), which projecting element forms the light exit area and of which the geometry corresponds to the cutout of a tube into which the lighting element can be inserted. A first contact element with a first polarity is arranged next to the central region. A second contact element with a second polarity is arranged on the rear side of the housing (that is to say with a circumferential position which is offset substantially through 180° in relation to the first contact element) and is of resilient design. The two contact elements serve not only for making electrical contact with the lighting element, but rather also mechanically secure said lighting element in the cutout of the tube.

Further advantageous embodiments and combinations of features of the invention can be gathered from the following detailed description and all of the patent claims.

BRIEF DESCRIPTION OF THE DRAWINGS

In the drawings used to illustrate the exemplary embodiment.

In principle, identical parts are provided with the same reference numerals throughout the figures.

WAYS OF IMPLEMENTING THE INVENTION

Figure 1:
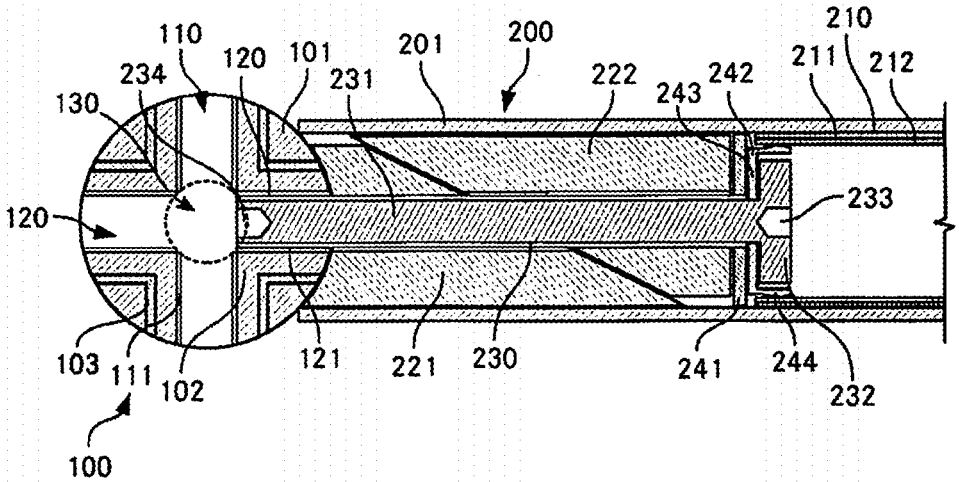
FIG. 1 shows a cross section through the connection of a node element to a tube of the furniture system according to the invention.

One embodiment of the furniture system according to the invention comprises tubes with a round cross section which can be connected by node elements to a three-dimensional load-bearing tube structure. In particular, shelves, covers, side parts, doors, flaps, drawers and similar elements can be fastened to the tube structure. FIG. 1 shows a cross section through the connection of a node element to a tube of this furniture system according to the invention.

The node element 100 is designed as a spherical connecting head. The node element comprises three threaded bores 110, 120, 130, the axes of which in each case run perpendicular to one another and diametrically through the center point of the sphere. Accordingly, the outer face of the node element 100 has six openings through which screws which interact with the threads 111, 121 can be inserted. Therefore, two to six tubes can be connected to one another with the aid of the node element 100 as required.

The node element 100 consists of an integral outer part 101, an integral inner part 102 and an electrical insulation layer 103 which is arranged therebetween. The threaded bores 110, 120, 130 run solely through the inner part 102. The outer part 101 and the inner part 102 are manufactured from chrome-plated brass; the insulation layer 103 is composed of a suitable plastic.

The tube 200, of which only an end-side section is illustrated in FIG. 1, comprises an outer casing 201 which is composed of chrome-plated steel. An inner tube 210 with an outer layer 211 which is composed of an insulating material, for example a plastic, and an inner layer 212 which is composed of a conductive material, for example copper, is accommodated in the outer casing. The inner tube 210 does not extend as far as the ends of the tube 200, but rather ends at a prespecified distance of, for example, approximately 10 cm. In the fastened state, the outer casing 201, by way of its free end, makes contact with the node element 100 in the region of its outer part 101. In order to increase the size of the contact area, the outer casing 201, in a departure from the illustrated exemplary embodiment, can have at the end side a geometry which is matched to the spherical surface.

In order to fasten the tube 200 to the node element 100, two wedge sleeves 221, 222, which are of substantially identical construction, and a cap screw 230, which is composed of electrically conductive material, are accommodated in the tube 200, wherein the cap screw 230 is inserted through the two wedge sleeves 221, 222 and, by way of the end of its threaded shaft 231, is screwed into the associated threaded bore 120 of the node element 100. The front wedge sleeve 221, which faces the node element 100, is produced from an electrically non-conductive material or has an electrical insulation in the region of the contact area with the tube 200, the cap screw 230 and/or the node element 100. An insulator ring 241 which is composed of an electrically insulating material, for example plastic, and a contact ring 242 which is composed of an electrically conductive material, for example sheet copper, are arranged between the cap 232 of the screw 230 and that end side of the wedge sleeve 222 which is averted from the node element 100. The contact ring 242 comprises an annular main part 243 and a resilient contact part 244 which is arranged circumferentially on the outside. In the mounted state, said contact part makes contact with the inner layer 212 of the inner tube 210.

The wedge sleeves 221, 222 are supported against one another by way of their wedge faces which are inclined in relation to the sleeve axis and are lined up, by way of their end side which is averted from the node element 100, with the cap 232 of the screw 230. The outside diameter of the wedge sleeves 221, 222 is smaller than the inside diameter of the tube end only by the play which allows the tube end to be pushed slightly onto said wedge sleeves. If the cap screw 230 is tightened after the tube 200 is pushed onto the wedge sleeves 221, 222, the wedge sleeves 221, 222 are forced against the inner side of the tube end and secure said tube end. The displacement of the wedge sleeve which is lined up with the screw cap further has a displacement component which is directed against the node element 100 and attempts to carry along the tube 200 toward the node element 100 and as a result ensures that secure contact is made between the outer casing 201 of the tube 200 and the outer part 101 of the node element 100.

In order to tighten and loosen the cap screw 230, the cap 232 of said cap screw is provided with a polygonal insertion hole 233 (or alternatively with a slot for engagement of a screwdriver). The end of the threaded shaft 231 of the screw 230 which is opposite the cap 232 also has a polygonal insertion hole 234 for inserting a key.

In relatively short tubes, the cap 232 of the screw 230 can be reached by means of a screwdriver or wrench. In many cases, such as when creating a corner connection for example, the polygonal insertion hole 234 of the threaded shaft 231 of the screw 230 is accessible through the unused opening of the threaded bore 120, which unused opening opens out diametrically opposite in the node element 100, by means of a corresponding polygonal socket wrench. Moreover, it has been found that, in the case of wedge sleeves which bear only lightly against the tube inner side for the moment, complete tightening or loosening of the screw 230 is also possible by correspondingly turning the tube 200 about its axis.

The openings of the threaded bores 110, 120, which openings are unused in a tube connection, are advantageously closed by in each case one grub screw after the screws 230 are tightened.

In the connected state, current can be transmitted between the tubes 200 and the node element 100 using two poles. In order to make contact with the first polarity (neutral conductor), the outer casing 201 of the tube 200 makes direct contact with the outer part 101 of the node element 100. The second polarity (phase) is routed in the inner layer 212 of the inner tube 210 in the region of the tube 200. There, the current is tapped off by the resilient contact part 244 of the contact ring 242 and transmitted to the cap 232 of the screw 230 by means of the main part 243. Contact is then made with the inner part 102 of the node element 100 by means of the threaded shaft 231 of the screw 230 and the thread 121 of the threaded bore 120 of the node element 100. Further tubes which are connected to the node element 100 in the same way are therefore electrically connected to the corresponding conductors of the tube 200, using two poles, by means of the outer part 101 and the inner part 102.

Power is supplied to the furniture system by means of a contact-making element which can be fastened to one of the node elements 100. The contact-making element comprises a housing with a receiving bore for a holding screw. Furthermore, two connection points for a two-pole connection cable are accommodated in the housing. A contact element is conductively connected to the connection points in each case. The contact-making element can be fastened by simply screwing the holding screw into any desired opening of a threaded bore of the node element. The contact elements then make contact with the outer part 101 or the inner part 102 of the node element 100.

For safety reasons, the voltage carried in the furniture system should not exceed 48 V; a highly suitable voltage value is 24 V.

Figure 2A:
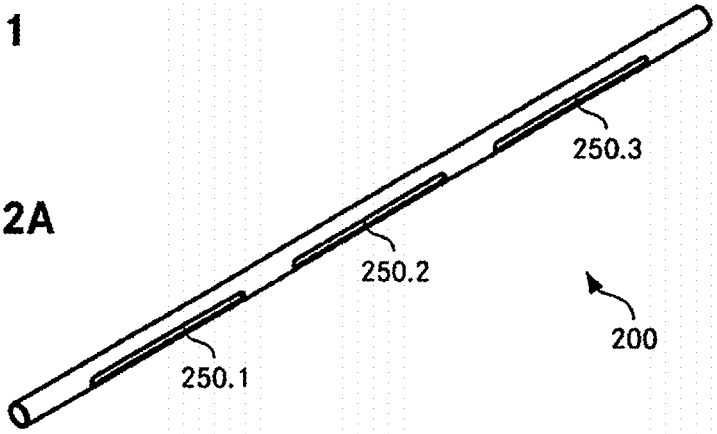
FIGS. 2A-C show an oblique view and two cross sections through a tube of the furniture system according to the invention with cutouts for accommodating load modules.
Figure 2B:
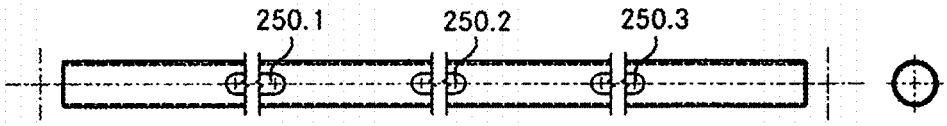
Figure 2C:
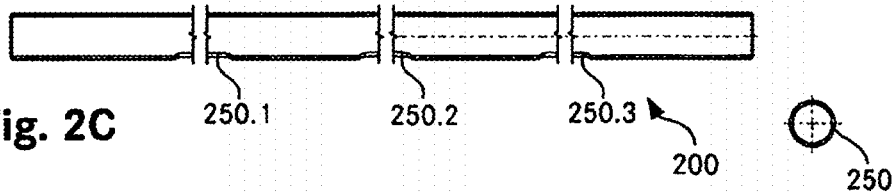

FIG. 2A shows an oblique view; FIGS. 2B, 2C each show two cross sections through a tube of the furniture system according to the invention with cutouts for accommodating load modules. FIG. 2B shows a cross section along a plane which runs through the center axis of the tube parallel to the areas defined by the cutouts, and also a cross section perpendicular to the center axis in a section of the tube without a cutout. FIG. 2C shows a cross section along a plane which runs through the center axis of the tube and is perpendicular to the areas which are defined by the cutouts, and also a cross section which is perpendicular to the center axis in a section of the tube with a cutout.

The tube 200 comprises three cutouts 250.1, 250.2, 250.3 of identical length which are uniformly spaced apart. The cutouts have an elongate rectangular shape with longitudinal ends which are rounded in the manner of a semicircle. According to the exemplary embodiment, the tube has an outside diameter of 19 mm, and the width of the cutouts is in each case 8.2 mm; the length is 163 mm. The distance of the outer cutouts 250.1, 250.3 from the respective tube end is 68 mm; the mutual distance between the cutouts 250.1, 250.2, 250.3 is in each case 53 mm.

The inner tube 210 (cf. FIG. 1) is cut out in a region surrounding the cutouts 250.1 . . . 3, and therefore the outer casing of the tube 200 is directly accessible.

Figure 3A:
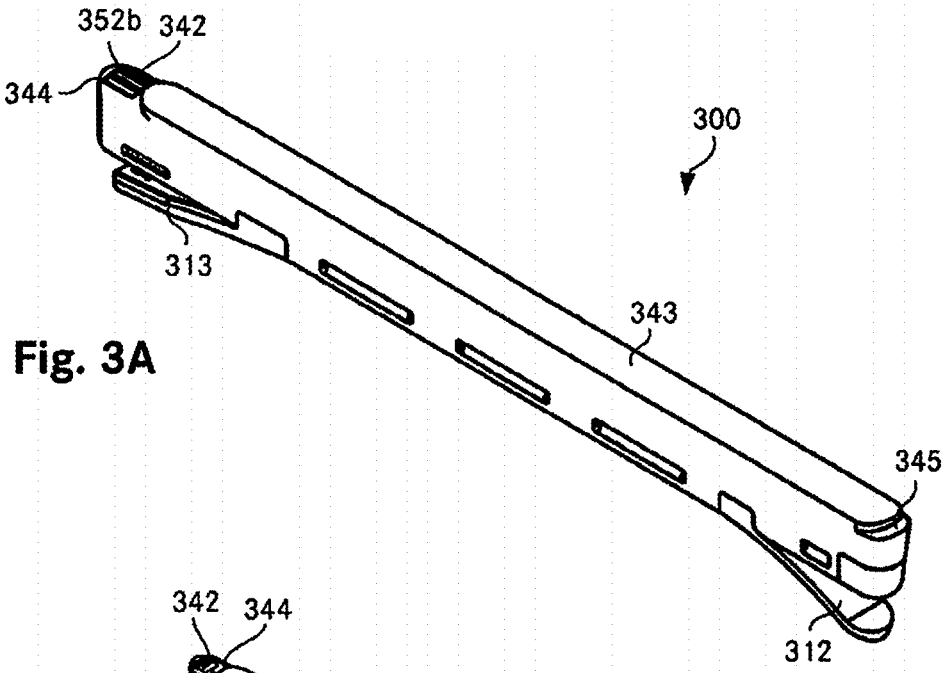
FIGS. 3A, B show an oblique view and an exploded view of a luminaire module according to the invention.
Figure 3B:
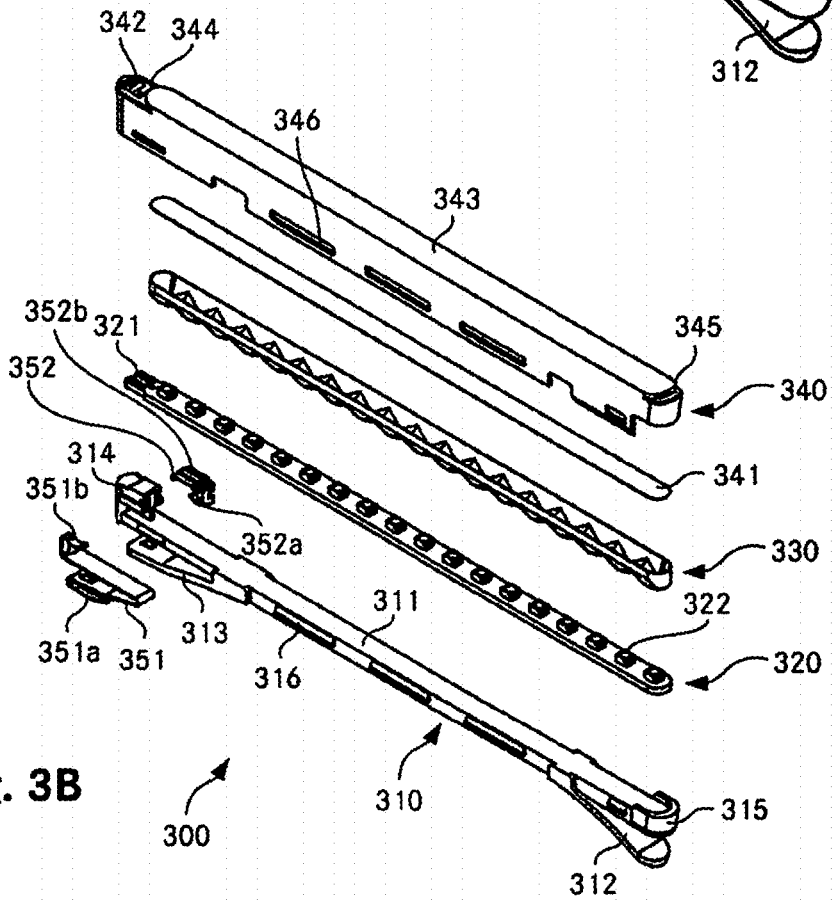

FIG. 3A shows an oblique view and FIG. 3B shows an exploded view of a luminaire module 300 according to the invention. Said luminaire module serves to emit light in a planar manner. Said luminaire module comprises an elongate carrier rail 310 which is composed of plastic, a printed circuit board 320 which is fastened on a top side of said carrier rail and has a plurality of LED lighting elements, a reflector 330 which is arranged on the top side of the printed circuit board 320, and a lens profile 340 which is provided on the inner side with a diffuser film 341, is fastened to the carrier rail 310 and, in the fastened state, surrounds the printed circuit board 320 and the reflector 330.

The carrier rail 310 comprises a flat base plate 311 with a substantially rectangular shape. Two spring sections 312, 313 are integrally formed with the base plate 311 on the bottom side of said base plate. Said spring sections extend, starting from the base plate 311, obliquely downward to the outside, in the direction of free ends of the base plate 311. The extent of said spring sections in the longitudinal direction corresponds in each case to approximately one fifth of the longitudinal extent of the luminaire module. When said spring sections rest on a mating surface, the spring sections 312, 313 oppose a vertical movement perpendicular to the main plane of the base plate 311 with a resistance which increases as the distance between the base plate and the mating surface decreases. The spring travel is such that the luminaire module 300 can temporarily move into the tube to such an extent that it is entirely accommodated in the tube cross section at least in its end regions. However, at the same time, the spring sections 312, 313 are also partially compressed when the luminaire element 300 is in the installed state, in order to reliably secure the luminaire element 300 in its position.

A holding element 314 is likewise integrally formed with the carrier rail 310, which holding element extends upward perpendicular to the main area of the carrier rail 310 in the region of one of the free ends of the carrier rail 310. An end termination 315 is integrally formed at the opposite free end of the carrier rail 310; a plurality of elongate projections 316 are integrally formed on the sides below the upper main area.

The printed circuit board 320 is mechanically fastened, at one of its ends, to the holding element 314. Two contacts 321 protrude into corresponding receptacles of the holding element 314, and therefore contact can be made with the printed circuit board 320 using two poles. LED lighting elements 322 are mounted at a uniform distance 18 on the top side of the printed circuit board 320, control electronics and components for supplying power to the LED lighting elements being arranged on the bottom side (not visible). The control electronics can comprise components for communicating with further modules or an external control device.

Two spring contacts are likewise mechanically fastened to the holding element 314. A first spring contact 351 is of Z-shaped design, extends to the bottom side of the carrier rail 310 and is furthermore also mechanically fastened to the corresponding spring section 313. The first spring contact 351 forms, on its bottom side, a first contact area 351*a*. The first spring contact 351 forms, at the opposite end, a second contact area 351*b*. In the mounted state, said second contact area interacts directly with one of the contacts 321 of the printed circuit board 320. The second spring contact 352 is of U-shaped design. In the mounted state, a first limb 352*a* interacts directly with the other of the contacts 321 of the printed circuit board 320. The second limb 352*b* is guided by means of the base of the second spring contact 352 onto the top side of the holding element 314 and there passes, through an opening 342 in the lens profile 340, beyond the upper outer side of the housing of the luminaire module 300.

The reflector 330 is elongate and has openings which correspond to the number and position of the LED lighting elements 322 and are surrounded by reflector regions. In the mounted state, the reflector is held in a fitting manner in the axial direction between the holding element 314 and the end termination 315 of the carrier rail 310.

The lens profile 340 which is composed of a transparent plastics material has a light exit area 343, the outer geometry of which is matched to the shape of the cutout 250 in the tube according to FIG. 2; the surface is therefore slightly curved and has a substantially rectangular shape with rounded corners. The light exit area 343 comprises integrally formed lens profiles which suitably focus or distribute the light which is emitted by the LED lighting elements. A recessed area 344 is located on a first side of the light exit area 343, said opening 342 being arranged in said recessed area and the upper limb 352*b* of the second spring contact 352 passing through said opening. A further recessed area 345 is located on the opposite side of the light exit area 343. The axial length of the light exit area 343 is—as in the case of the cutout 250—163 mm. The recessed area 344 which is provided with the opening 342 has an axial length of 9.2 mm; the other recessed area 345 has an axial length of 2 mm.

The side faces of the lens profile 340 are provided with cutouts 346, the geometry of which corresponds to the elongate projections 316 of the carrier rail 310. The lens profile 340 can be mechanically securely fastened to the carrier rail 310 by virtue of the interaction of the cutouts 346 with the projections 316. At the same time, the further elements of the luminaire module 300 are fixed between said two components.

Figure 4A:
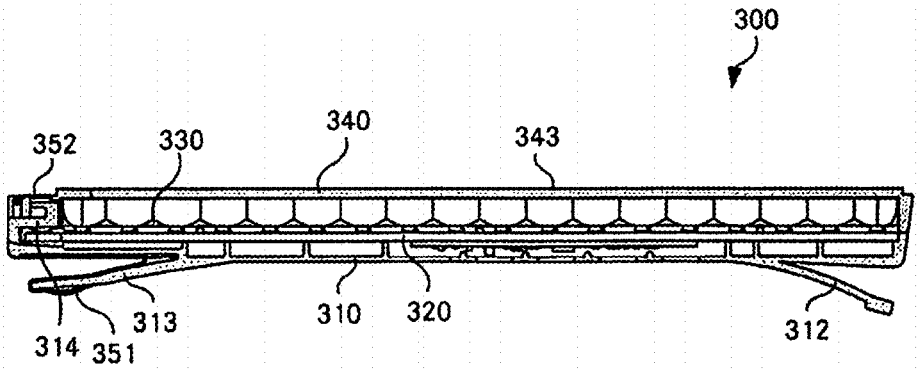
FIGS. 4A, B show cross sections through the luminaire module according to the invention.
Figure 4B:
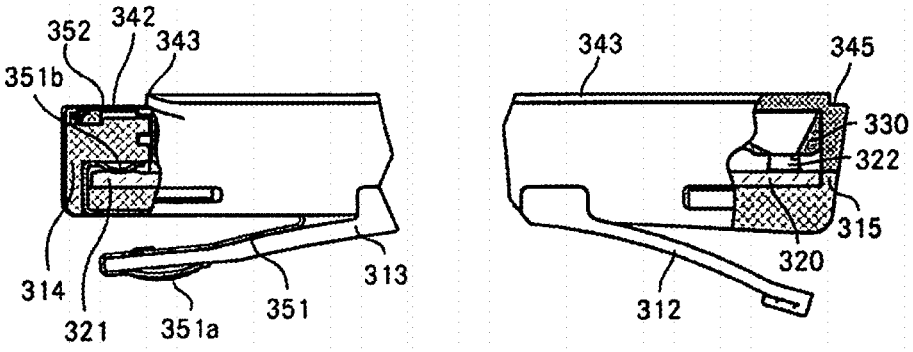

The luminaire module 300 is illustrated in the mounted state in FIG. 3A and furthermore in FIG. 4. FIG. 4A shows a cross section along a center axis of the luminaire module 300, perpendicular in relation to the light exit area 343 and in relation to the main area of the carrier rail 310. FIG. 4B shows the same cross section in the two end regions of the luminaire module 300 on an enlarged scale.

Figure 5:
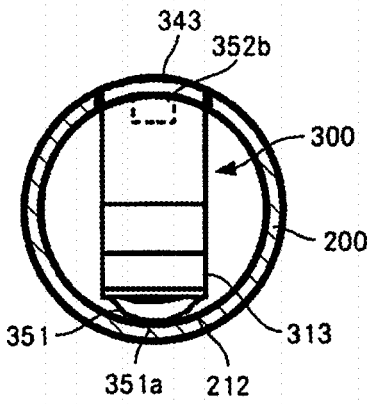
FIG. 5 shows a cross section through the tube with the luminaire module inserted.

FIG. 5 shows a cross section through the tube 200 with the luminaire module 300 inserted. The spring section 313 is partially compressed. The luminaire module 300 makes contact with the tube 200 on the bottom side by means of the contact area 351*a* of the spring contact 351 and the lower face of the spring section 312. On the top side, the luminaire module 300 makes contact with the tube 200 in the region of the two recessed areas 344, 345 to the side of the light exit area 343. On account of the partially compressed spring section 313, these four contact points securely hold the luminaire module 300 in a first radial direction and in a clearly defined position in the tube 200.

Axial securing and securing in a second radial direction, perpendicular to the first radial direction, are produced by the light exit area 343 being accommodated with an accurate fit in the cutout 250. The upper limb 352*b* of the second spring contact 352 makes conductive contact with the inner casing of the tube 200; the lower limb 351*a* of the first spring contact 351 makes conductive contact with the inner conductor 212 which is routed in the tube 200. Therefore, electrical contact is made with the luminaire module 300 which is inserted into the tube 200 using two poles.

The luminaire module 300 can be inserted into the tube 200 by said luminaire module being inserted, with one of the ends at the front, through the cutout into the tube 200. By virtue of compressing the corresponding spring section 312, 313, the luminaire module 300 can be moved into the tube 200 so deeply that even the light exit area 343 temporarily passes behind the tube inner wall, which adjoins the cutout, in a region which adjoins the respective recessed area 344, 345. The luminaire module 300 can then, by way of the opposite end, likewise be inserted into the tube 200. Subsequently, the luminaire module 300 is axially displaced, until the light exit area 343 is accommodated in the cutout in a fitting manner.

For removal purposes, the luminaire module 300 is pushed slightly inward against the force of the spring sections 312, 313 until it can be axially displaced in one direction. The light exit area 343 once again temporarily passes behind the tube inner wall, which adjoins the cutout, in a region which adjoins the respective recessed area 344, 345. The respectively other end of the luminaire module 300 is then pushed outward owing to the spring force of the corresponding spring section 312, 313, and therefore the luminaire module 300 can be grasped and removed.

Figure 6:
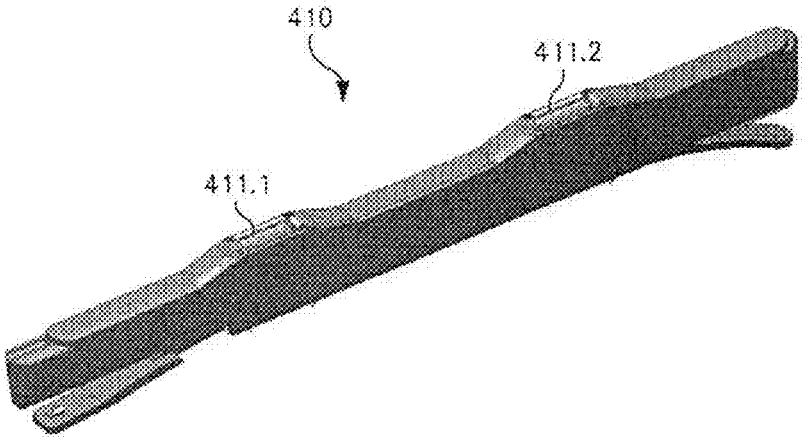
FIG. 6 shows an oblique view of a load module with two plug sockets.

FIG. 6 shows an oblique view of a load module with two plug sockets. The geometry of the load module 410 corresponds substantially to that of the luminaire module 300, as has been described in connection with FIGS. 2-5. Two plug sockets 411.1, 411.2 according to the USB standard are arranged in the central section of the upper area (corresponding to the light exit area of the luminaire module). Said plug sockets are supplied with power from the tube by means of said contacts and said power is converted by corresponding electronic elements which are accommodated in the housing of the load module 410, and therefore a power connection according to the USB standard is available at the two plug sockets 411.1, 411.2. Devices can be supplied with power or charged by means of the USB plug sockets. Data transmission by means of the USB plug sockets is also possible in principle.

Figure 7:
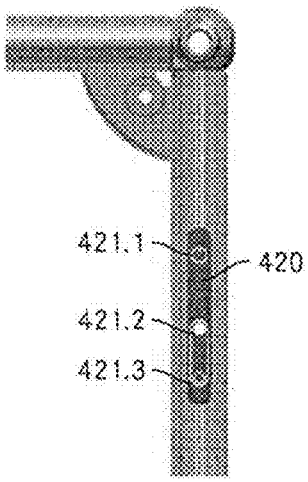
FIG. 7 shows an oblique view of an insert module with switching elements.

FIG. 7 shows an oblique view of an insert module with switching elements. The geometry of the insert module 420 once again corresponds substantially to that of the luminaire module 300, as has been described in connection with FIGS. 2 to 5. Operator control elements, specifically three sensor buttons 421.1, 421.2, 421.3, are formed in the central section of the upper area (corresponding to the light exit area of the luminaire module). A load, for example a luminaire, can be switched on and off by way of the first sensor button 421.1. A parameter of the load, for example a brightness of the luminaire, can be increased or lowered by way of the two further sensor buttons 421.1, 421.3. The load can be accommodated in the same insert module. If this is not the case, the control pulses are transmitted to the corresponding load module by means of the power supply line in a manner which is known per se by said control pulses being modulated onto the line (powerline communication, PLC). Corresponding electronics are contained in the insert module and in the load module.

In a similar way, a series of control and load modules and also further modules, such as sensor modules for example, can communicate with one another. Each module is identified by a unique number. Assignment of the modules can be performed in pairs, but more complex relationships can also be realized. Assignment is performed with the aid of an external control device or by a "pairing" method which can be initiated solely by operator control of the modules.

An insert module which can be used within the scope of the system according to the invention can comprise entirely different control elements. In the simplest case, there is only one control element; in more complex cases, a series of control elements can be provided. That part of the central section of the upper area which is not used by the control elements, that is to say that area which is visible through the cutout, can be provided with a coating which corresponds to the tube outer side, so that primarily the control elements are visible from the outside.

The invention is not limited to the described load and insert modules. By way of example, a luminaire module can also have one or more spotlight sources with a distinguished lighting direction. The spots can be adjustable. Similarly, modules in which the light source is arranged at the free end of a movable element which protrudes out of the tube in the mounted state of the module, for example of a gooseneck, are feasible.

The light sources can be designed in such a way that their color or color temperature can be controlled. The same applies for the brightness. The modules can comprise light sensors in order to, for example, automatically switch on the light when a certain level of ambient brightness is undershot. Similarly, proximity, motion or presence sensors can be used. Furthermore, a state of an element of the furniture system, for example a door or flap, can be monitored by means of a sensor. For example, an opening sensor can be used, which opening sensor establishes, with the aid of an infrared LED and a phototransistor for detecting reflected light, whether the flap or door is open or closed. By way of example, a light source can be automatically switched on or off on the basis of the result.

In summary, it can be determined that the invention provides a load module which can be held and with which contact can be made in a simple and reliable manner in the tube of the three-dimensional load-bearing tube structure.

The invention claimed is:

1. A load module for insertion into a tube of a three-dimensional load-bearing tube structure of a furniture system, the load module comprises:

an elongate housing;

two contact elements for making electrical contact with the load module, which contact elements have different polarities, are arranged on an outer side of the elongate housing, the contact elements are arranged in such a way that, when the load module is in an inserted state, the contact elements make contact in a radial direction with two contact areas of different polarity which are arranged in an interior of the tube and the elongate housing has a region which is central in a longitudinal direction, which region has at least one projecting element, and also regions which are on an outside in the longitudinal direction;

the load module can be inserted into a tube of the tube structure, which tube is provided with an elongate cutout, in such a way that the at least one projecting element interacts with an edge of the cutout, and the outer regions bear against an inner casing of the tube in regions which adjoin the cutout; and a first of the contact elements is arranged in one of the outer regions, in a first circumferential position.

2. The load module as claimed in claim 1, wherein a second of the contact elements is arranged in a second circumferential position which encloses an angle selected from the group consisting of at least 60°, or 135°, with the first circumferential position.

3. The load module as claimed in claim 1, wherein at least one of the contact elements is of resilient design.

4. The load module as claimed in claim 1, comprising a lighting element.

5. The load module as claimed in claim 4, wherein a light exit area of the lighting element is arranged in the central region of the housing.

6. A furniture system with a three-dimensional load-bearing tube structure, said system comprising:

a) a plurality of tubes, wherein at least one of the tubes has two contact areas of different polarity which are arranged in an interior of the at least one tube;

b) a plurality of three-dimensional node elements for mechanically fastening two or more tubes to one another; and c) at least one load module for insertion into the at least one tube of the three-dimensional load-bearing tube structure of the furniture system, wherein the load module comprises an elongate housing, and wherein the two contact elements for making electrical contact with the load module, which contact elements have different polarities, are arranged on an outer side of the housing, and the contact elements are arranged in such a way that, when the load module is in an inserted state, they make contact in a substantially radial direction with two contact areas of different polarity which are arranged in the interior of the at least one tube.

7. The furniture system as claimed in claim 6, wherein the at least one of the tubes has two current conductors, which run along the tube and are insulated from one another, for carrying current of a first polarity and of a second polarity along the at least one tube.

8. The furniture system as claimed in claim 7, wherein the two current conductors, which are insulated from one another, for carrying current are arranged coaxially to one another in the at least one tube.

9. The furniture system as claimed in claim 8, wherein the at least one tube comprises a structural tube element which is composed of a conductive material and serves to carry the first polarity, and an internal conductor, which is accommodated in an insulated manner in the structural tube element, for carrying the second polarity.

10. The furniture system as claimed in claim 9, wherein the internal conductor is formed by a conductive foil which is inserted into the at least one tube and is insulated at one end.

11. The furniture system as claimed in claim 6, wherein the at least one tube has an elongate cutout, and in that the at least one load module is designed in such a way that it can be inserted into the at least one tube through the elongate cutout.

12. The furniture system as claimed in claim 11, wherein a first of the contact elements of the at least one load module, with the load module inserted, is arranged in a region of the load module, which region adjoins the cutout.

13. The furniture system as claimed in claim 12, wherein a second of the contact elements of the at least one load module, with the load module inserted, is arranged in a region of the load module, which region is at a rear in relation to the cutout.

* * * * *